US010181627B2

(12) United States Patent
Kroening

(10) Patent No.: US 10,181,627 B2
(45) Date of Patent: Jan. 15, 2019

(54) THREE-PORT VARIABLE POWER DIVIDER

(71) Applicant: Honeywell International Inc., Morristown, NJ (US)

(72) Inventor: Adam M. Kroening, Atlanta, GA (US)

(73) Assignee: Honeywell International Inc., Morris Plains, NJ (US)

( * ) Notice: Subject to any disclaimer, the term of this patent is extended or adjusted under 35 U.S.C. 154(b) by 693 days.

(21) Appl. No.: 14/830,219

(22) Filed: Aug. 19, 2015

(65) Prior Publication Data

US 2017/0054193 A1 Feb. 23, 2017

(51) Int. Cl.
*H01P 1/383* (2006.01)
*H01F 7/06* (2006.01)

(52) U.S. Cl.
CPC ..... *H01P 1/383* (2013.01); *H01F 7/064* (2013.01)

(58) Field of Classification Search
CPC ..... H01P 1/383; H01F 7/064
USPC ..... 361/152
See application file for complete search history.

(56) References Cited

U.S. PATENT DOCUMENTS 3,474,454 A 10/1969 Woermbke et al.
3,769,610 A 10/1973 Savarin et al.
3,928,806 A * 12/1975 Carter ..... H01P 1/362 330/124 D
4,012,644 A 3/1977 Blincoe
4,445,098 A 4/1984 Sharon et al.
5,075,648 A 12/1991 Roberts et al.
5,089,716 A 2/1992 Wallis et al.
5,473,294 A 12/1995 Mizzoni et al.
6,377,133 B1 4/2002 Ihmels et al.
6,788,165 B2 9/2004 Runyon
6,822,533 B2 11/2004 Trammell et al.
7,221,239 B2 5/2007 Runyon
7,569,951 B2 8/2009 Bohanan et al.
8,786,378 B2 7/2014 Kroening
8,878,623 B2 11/2014 Kroening
(Continued)

OTHER PUBLICATIONS

European Patent Office, "Extended European Search Report from EP Application 16184388.3, dated Dec. 1, 2016", "from Foreign Counterpart of U.S. Appl. No. 14/830,219", Dec. 1, 2016, pp. 1-7.
(Continued)

*Primary Examiner* — Kevin J Comber
(74) *Attorney, Agent, or Firm* — Fogg & Powers LLC

(57) ABSTRACT

A variable power divider comprising a latching ferrite circulator including an input port, a first output port, a second output port, and at least one winding. The ports meet in a common junction. The variable power divider also includes a controller interface that receives a command signal indicating a desired power division ratio and a driver circuit configured to receive a control signal from the controller interface. The driver circuit generates a first pulse, having a duration and amplitude corresponding to a saturation state of the latching ferrite circulator, in a first direction through the at least one winding. After the first pulse, the driver circuit generates a second pulse in a second direction through the at least one winding opposite the first direction, the second pulse having a duration and amplitude determined from the desired power division ratio and corresponding to a non-saturation state of the latching ferrite circulator.

20 Claims, 13 Drawing Sheets

(56) References Cited

U.S. PATENT DOCUMENTS

| | | | |
|---|---|---|---|
| 8,947,173 | B2 | 2/2015 | Kroening |
| 2004/0119550 | A1 | 6/2004 | Trammell et al. |
| 2014/0049335 | A1 | 2/2014 | Kroening |
| 2014/0308893 | A1 | 10/2014 | Miller |
| 2015/0009891 | A1 | 1/2015 | Miller et al. |

OTHER PUBLICATIONS

Bahri et al., "Analysis and Design of New Active Quasi Circulator and Circulators", "Progress in Electromagnetics Research, PIER", 2009, pp. 377-395, Published in: US.

Matthews, "Variable Power Dividers in Satellite Systems", "Aeronutronic Ford, Western Development Laboratories Division", Jun. 14-16, 1976, pp. 338-340, Published in: US.

* cited by examiner

THREE-PORT VARIABLE POWER DIVIDER

BACKGROUND

Ferrite junction switching circulators are three-port devices used to route RF energy from a first port to a second port, while isolating a third port. If switched to circulate in the opposite direction (generally referred to as clockwise or counter-clockwise directions), then they can route RF energy from the first port to the third port, while isolating the second port. This functionality is used in RF systems such as beam forming networks and switched beam antennas to reconfigure the antenna pattern of the system. In this manner, the switching circulators route the RF energy from a single source to a single radiating antenna element to provide a spot beam hopping function.

To provide more options for beam steering, variable power dividers (VPDs) can be used to route the RF energy from a single source to a plurality of radiating antenna elements with an electronically controllable weighting or ratio of power between the elements. The ratio of the input power distributed to each of the two output ports of a single VPD can be varied essentially anywhere from 0 to 1, with a step size determined by the application's needs. Networks (binary trees) of VPDs are constructed based on the number of radiating antenna elements. VPD applications include satellite and terrestrial, communications and radar, and any other application where electronic beam steering is desired.

Current variable power dividers are either too large, have moving parts that cannot be quickly reconfigured, or cannot be electronically controlled. Typical implementation of electronically controlled VPDs requires 2 power dividers and 2 phase shifters and are therefore quite large (5 to 10 times larger) in comparison to a switching circulator.

Three-port switching circulators can be electronically controlled to provide a variable power division. However, current three-port switching circulator variable power dividers are limited to three output power ratios, typically 0, 0.5, and 1. Some variable power dividers incorporate physical changes to the circulator to provide different ratios other than 0.5 (50/50), but the ratio is varied by physical changes to the dimensions or alignment, so any single implementation is limited to three output ratios.

For the reasons stated above and for other reasons stated below, which will become apparent to those skilled in the art upon reading and understanding the specification, there is a need in the art for improved systems and methods for variable power division.

SUMMARY

The embodiments of the present disclosure provide systems and methods for variable power division and will be understood by reading and studying the following specification.

In one embodiment, a variable power divider comprises a latching ferrite circulator that includes an input port, a first output port, a second output port, and at least one magnetizing winding. The input port, first output port, and the second output port meet in a common junction. The variable power divider also includes a controller interface having an input that receives a command signal indicating a desired power division ratio for dividing power received at the input port between the first output port and the second output port. The variable power divider also includes a driver circuit coupled to the controller interface, wherein the driver circuit is configured to receive a control signal from the controller interface. The driver circuit generates a first current pulse in a first direction through the at least one magnetizing winding, the first current pulse having a duration and amplitude corresponding to a first saturation state of the latching ferrite circulator. The driver circuit, after the first current pulse, generates a second current pulse in a second direction through the at least one magnetizing winding opposite to the first direction, the second current pulse having a duration and amplitude determined from the desired power division ratio indicated by the command signal and corresponding to a non-saturation state of the latching ferrite circulator.

DRAWINGS

Understanding that the drawings depict only exemplary embodiments and are not therefore to be considered limiting in scope, the exemplary embodiments will be described with additional specificity and detail through the use of the accompanying drawings, in which.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. The following detailed description is, therefore, not to be taken in a limiting sense.

The embodiments described below include systems and methods for a compact three-port device that provides a variable output power ratio between two output ports that can be electronically controlled to any setting. Specifically, the output power for each output port can be varied between 0 (no power to the port and full power to the other port) to 1 (full power to the port and no power to the other port). Such power division is not limited to specific ratios, but can provide power division across a continuous range such that 0-100% of the power can be output from either of the output ports. The embodiments described below include a three-port latching ferrite circulator controlled by a controller interface and driver circuit configured to provide multiple current pulses. A first pulse, referred to as a saturating pulse, is applied in a first direction to saturate the switching element in a particular direction. A second pulse, referred to as a set pulse, is applied in a second direction opposite to the first direction to finely adjust the output power ratio between the two output ports of the latching ferrite circulator.

Variable power dividers that operate over a continuous range of output power ratios between two output ports, such as the variable power dividers described below, can be used for antenna and beam steering applications. These variable power dividers are particularly beneficial for space applications, including satellites, because population fluctuations and physical changes with the satellites can affect the demand on the system.

Figure 1:
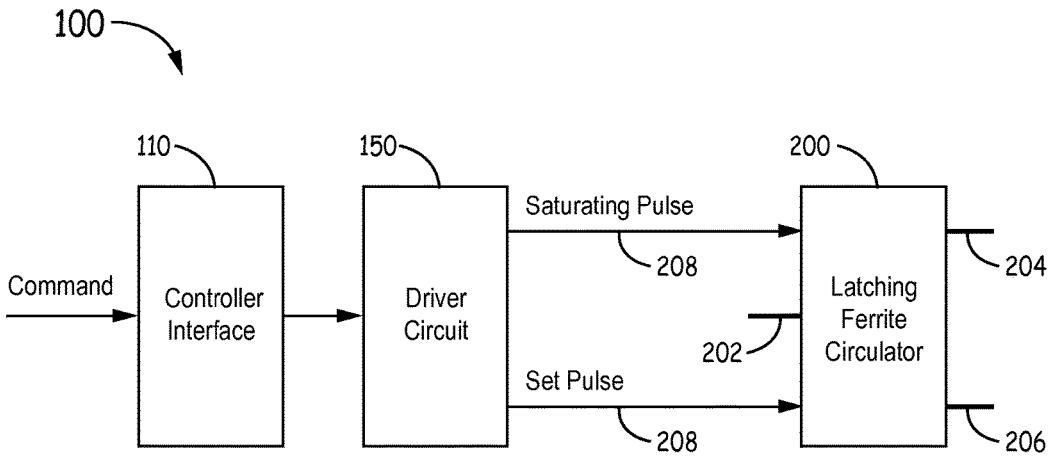
FIG. 1 is a block diagram illustrating an example variable power divider according to an embodiment of the present disclosure.
Figure 3A:
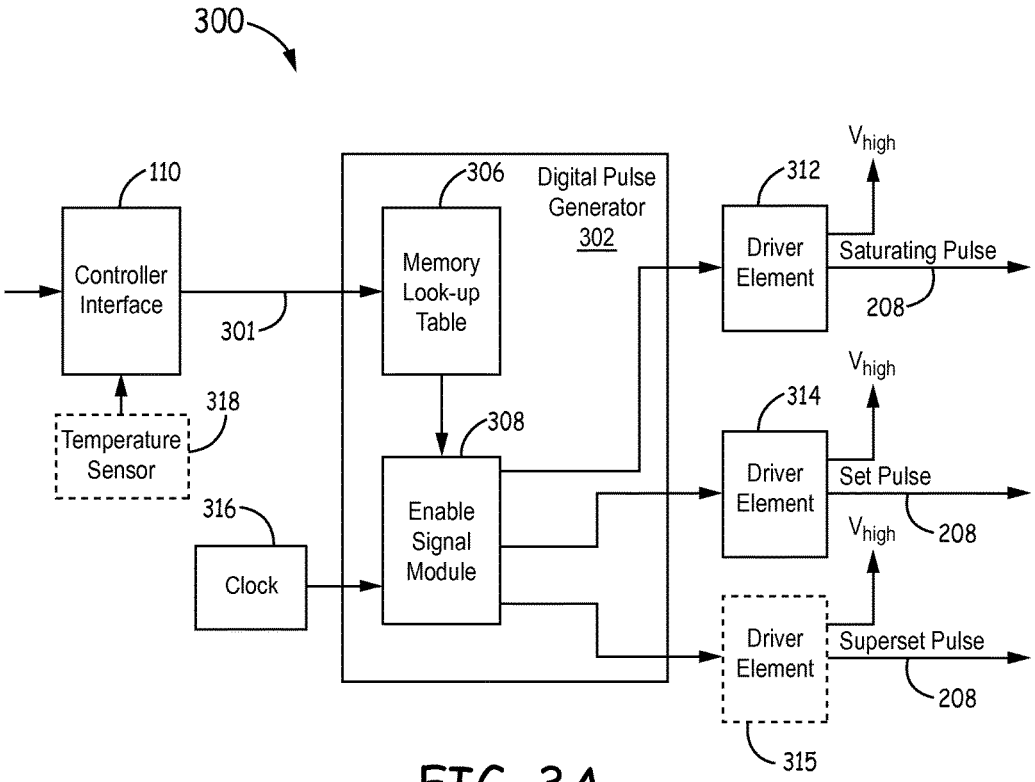
FIG. 3A is a block diagram illustrating a driver circuit of a variable power divider according to one embodiment of the present disclosure.
Figure 3B:
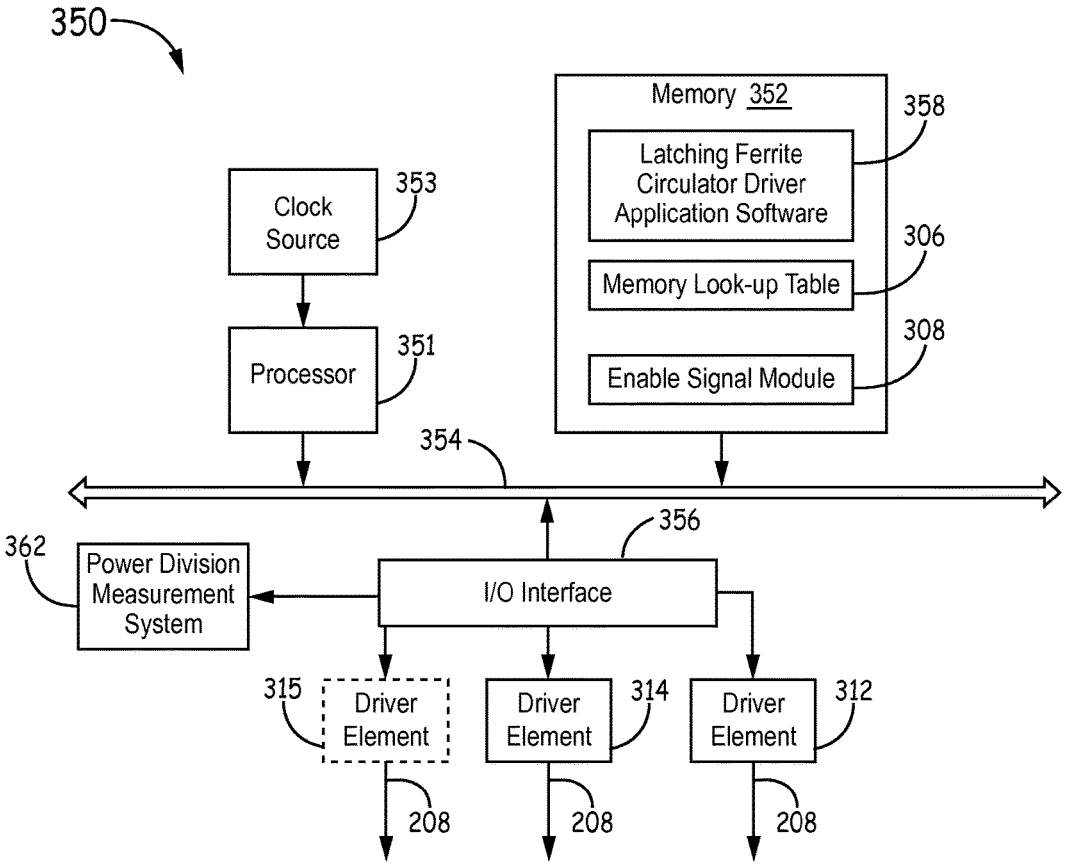
FIG. 3B is a block diagram illustrating a driver circuit of a variable power divider according to one embodiment of the present disclosure.
Figure 3C:
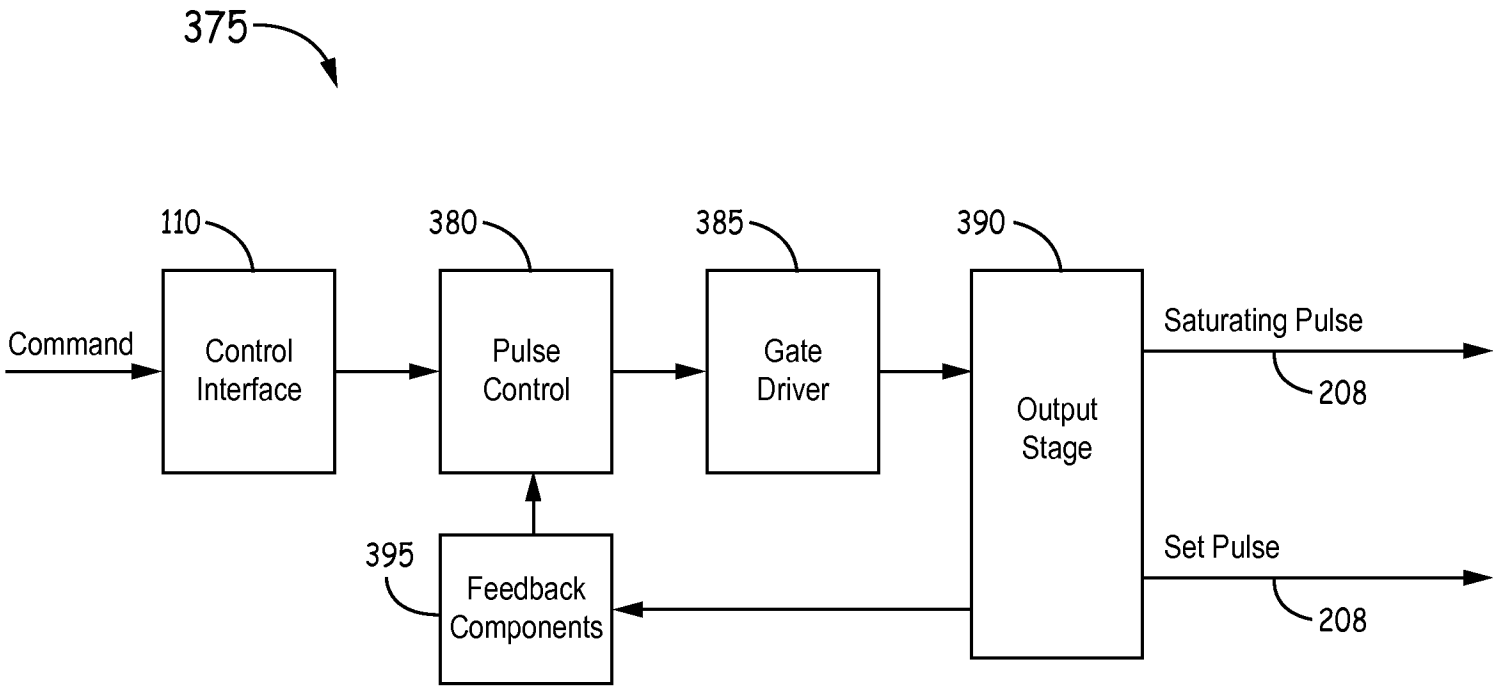
FIG. 3C is a block diagram illustrating a driver circuit of a variable power divider according to one embodiment of the present disclosure.

FIG. 1 is a block diagram illustrating an example variable power divider 100 according to an embodiment of the present disclosure. Variable power divider 100 includes a controller interface 110, a driver circuit 150, and a latching ferrite circulator 200. The controller interface 110 has an input for receiving a command signal indicating a desired output power ratio between the first and second output ports of the latching ferrite circulator 200. The controller interface 110 outputs a control signal to the driver circuit 150. The driver circuit 150 applies at least two current pulses, a saturating pulse and a set pulse, to the latching ferrite circulator 200 based on the command signal. The pulses adjust the magnetization state of the latching ferrite circulator 200 and provide variable power division. In exemplary embodiments, the driver circuit 150 can be implemented using analog and digital means known to those having skill in the art. FIGS. 3A-3C discussed below illustrate example embodiments of different driver circuit configurations that can be used to apply a saturating pulse and a set pulse to a latching ferrite circulator 200. However, it should be understood that other configurations of the driver circuit 150 that can apply a saturating pulse and a set pulse for a latching ferrite circulator 200 can be used and are within the scope of this disclosure.

In exemplary embodiments, the latching ferrite circulator 200 includes three waveguide arms connected to each other and arranged in a Y-shape. In such embodiments, one of waveguide arms functions as an input port 202 and two waveguide arms function as output ports 204, 206 for variable power division. In such embodiments, latching ferrite circulator 200 includes a switching element made from a non-reciprocal material, such as a ferrite, and is y-shaped. In other embodiments, the switching element can be a triangular puck, a cylinder, and the like. In certain implementations, a quarter wave dielectric transformer is attached to the ends of the switching element that are farthest away from the middle of the switching element. In alternative implementations, the switching element transitions to the air-filled waveguide arm without an aiding dielectric transformer.

Magnetic fields created in switching element, can be used to circulate a microwave signal from one port to another port. In exemplary embodiments, the switching element is latchable. To make the switching element latchable, a single magnetizing winding 208 is threaded through apertures in the switching element. In alternative embodiments, the magnetizing winding 208 comprises two separate windings threaded through the same apertures in the switching element. The magnetizing winding 208 allows for the control and establishment of an out-of-plane magnetic field in the switching element. The polarity of the magnetic field can be switched by the application of current on the magnetizing winding 208. The magnetizing winding 208 is coupled to the driver circuit 150, which controls the magnetization state of the switching element of the latching ferrite circulator 200.

To change the level of magnetization of the switching element of the ferrite circulator, and thus the output power ratio between the two output ports, the driver circuit 150 applies a sequence of current pulses to the winding 208 of the latching ferrite circulator 200. The output power ratio, also referred to as power division ratio, is the ratio of the input power distributed to each of the two output ports 204, 206 of the latching ferrite circulator 200. For example, if it is desirable to distribute the power from the input port 202 as 60% through the first output port 204 and 40% through the second output port 206, then the output power ratio would be 0.6 to the first output port 204 and 0.4 to the second output port 206.

Figure 2A:
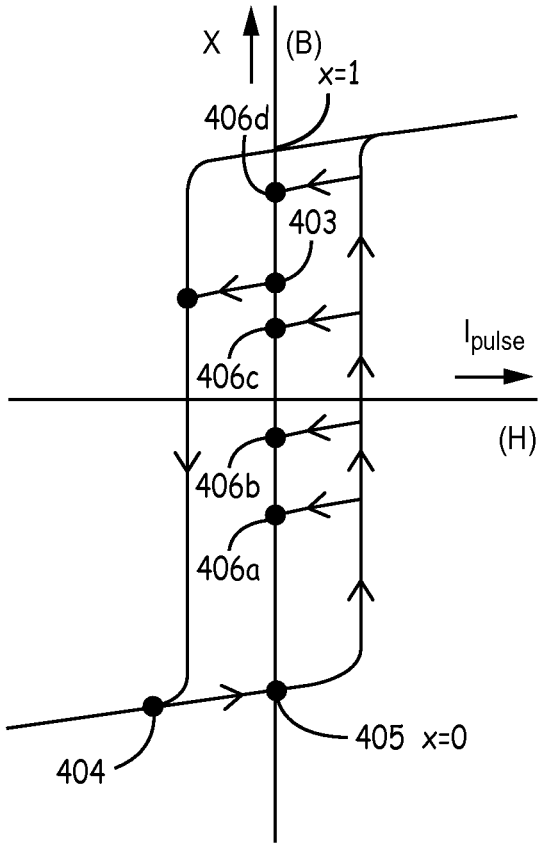
FIG. 2A is a diagram illustrating a B-H loop for an example variable power divider according to one embodiment of the present disclosure.

FIG. 2A illustrates a B-H loop corresponding to a saturating pulse being driven through the latching ferrite circulator 200 followed by a set pulse. Point 403 along the vertical axis (output power ratio x) corresponds to a level of magnetization in the switching element due to a previous set pulse. To change the magnetization, the driver circuit 150 generates a saturating pulse of an appropriate amplitude and duration through the switching element. The saturating pulse saturates the switching element in a first direction. The saturating pulse causes the magnetization in switching element to transition from point 403 to an intermediate state represented by point 404 before latching to the reference magnetization condition, which is represented by point 405. The reference magnetization condition provides a known, initial state that is independent of any previous level of magnetization.

Once the switching element has a magnetization level corresponding to point 405, the driver circuit 150 generates a set pulse of suitable amplitude and duration through switching element. The set pulse causes the magnetization level to change from point 405 to the desired point 406, which corresponds to a desired output power ratio. In this example, the ratio of power distributed to one output port would be x and the ratio of power distributed to the other output port would be 1-x for the ideal case. For example, if the power was to be evenly distributed, then x would equal 0.5. The greater the duration of the set pulse, the greater the amount of power distribution to the output port for that direction. Conversely, a shorter set pulse results is less power distribution to the output port for that direction. For example, points 406*c* and 406*d* are magnetization states that correspond to greater durations of the set pulse and points 406*a* and 406*b* are magnetization states that correspond to shorter durations of the set pulse.

In alternative embodiments, the saturating-set sequence of operation is preceded by driving the switching element with a superset pulse. The superset pulse is used to overcome problems associated with a memory effect that may be present in some switching elements. In such embodiments, the driver circuit 150 generates a superset pulse through the winding 208 of latching ferrite circulator 200.

Figure 2B:
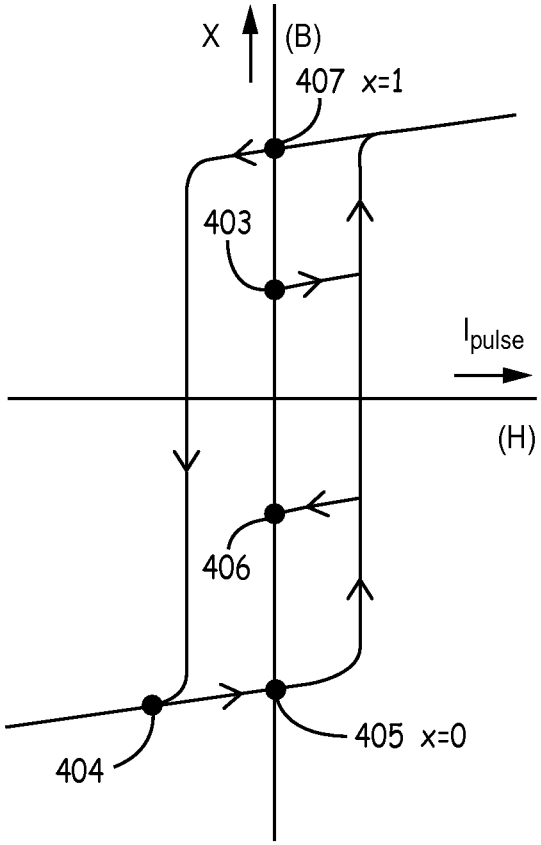
FIG. 2B is a diagram illustrating a B-H loop for an example variable power divider according to one embodiment of the present disclosure.

FIG. 2B illustrates a B-H loop corresponding to a superset pulse being driven through the latching ferrite circulator 200 prior to the saturating-set sequence. In such embodiments, the driver circuit 150 generates a superset pulse through the magnetizing winding 208 to change the magnetization level of the switching element from point 403 to a saturation level represented by point 407. The superset pulse saturates the switching element in a second direction. The saturating pulse is then applied to change the magnetization level from point 407 to point 405. A set pulse is applied after the saturating pulse to cause a transition from point 405 to point 406, which corresponds to a desired output power ratio between the two output ports.

FIG. 3A is a block diagram illustrating an example driver circuit 300 according to an embodiment of the present disclosure. The driver circuit 300 comprises a digital pulse generator 302 including a memory look-up table 306 and an enable signal module 308. The driver circuit 300 also includes driver elements 312, 314, 315 and a clock 316. The driver circuit 300 can also optionally include a temperature sensor 318 coupled to controller interface 110. In exemplary embodiments, the controller interface 110 receives input from the temperature sensor 318 and applies compensations to the command signal based on the operating temperature of the variable power divider 100.

The digital pulse generator 302 generates pulse enable signals in response to a received control signal 301 to establish a desired power division ratio between the two output ports. The controller interface 110 initiates a change in the output power ratio by providing an address value to the memory look-up table 306 that corresponds to a desired output power ratio between the two output ports.

Memory look-up table 306 contains a list of a plurality output power ratios. Each output power ratio corresponds to a specific current pulse, which is defined by its width (duration). To produce a current pulse of a desired width, the pulse enable signal is applied for a particular number of clock counts. For example, a pulse width of two clock counts would produce a greater current pulse than a pulse width of one clock count. The memory look-up table 306 also includes the corresponding pulse width information, also referred to as pulse duration information, which will produce the plurality of output power ratios. The memory look-up table 306 can be created through experimentation and can include any number of desired output power ratios and corresponding pulse width information. Each of the output power ratios is given a specific address in the memory look-up table 306 so the information can be accessed quickly.

The memory look-up table 306 provides pulse width information to the enable signal module 308 that corresponds to the desired output power ratio. In alternative implementations, the controller interface 110 sends the pulse width information directly to the enable signal module 308 without using the memory look-up table 306. The enable signal module 308 generates a saturating pulse enable signal, a set pulse enable signal, and optionally, a superset pulse enable signal using the pulse width information from the memory look-up table 306 and clock counts provided by clock 316. The enable signal module 308 provides the pulse enable signals to the driver elements 312, 314, 315 which apply the pulses to the magnetizing winding 208. In exemplary embodiments, the driver elements 312, 314, 315 are metal-oxide-semiconductor field-effect-transistors (MOSFETs) and the enable signal module 308 is coupled to the gate terminal of the MOSFETs. In other embodiments, other driver elements may be used, for example, bipolar junction field-effect-transistors or silicon controlled rectifiers.

The first pulse enable signal is a saturating pulse enable signal that is provided to the first driver element 312. The saturating pulse enable signal drives the first driver element 312 to produce a saturating pulse on the magnetizing winding 208. The saturating pulse results in a current flow in a first direction through the winding 208 of latching ferrite circulator 200. The saturating pulse establishes a reference magnetization condition for the latching ferrite circulator 200 that allows the driver circuit 300 to generate the set pulse in a consistent manner. Therefore, the saturating pulse must have a large enough amplitude and duration to saturate the latching ferrite circulator 200 in the first direction. In exemplary embodiments, the amplitude and duration of the saturating pulse is determined based on the amplitude and duration of the previous set pulse that was applied. In other embodiments, the saturating pulse is an amplitude and duration that will saturate the switching element of the latching ferrite circulator 200 regardless of the previous set pulse. The amplitude of the saturating pulse is determined by the supply voltage $V_{high}$ that is provided to the first driver element 312.

The second pulse enable signal is a set pulse enable signal that is provided to the second driver element 314. The set pulse enable signal drives driver element 314 to produce a set pulse on the magnetizing winding 208. The amplitude and duration of the set pulse establishes the desired output power ratio between the two output ports. In exemplary embodiments, the set pulse is a non-saturating pulse. The set pulse results in a current flow through winding 208 of the latching ferrite circulator 200 in a second direction that is opposite to the first direction. For example, if the saturating pulse is applied in a clockwise direction, the set pulse would be applied in a counter-clockwise direction. Suitable switching circuitry may be used to route the two current pulses through the commonly-shared winding 208 in opposite directions at different times. In alternative embodiments, two independent windings are included in the latching ferrite circulator 200 and the first and second current pulses are each applied to a different winding.

In exemplary embodiments where the optional superset pulse is generated before the saturating pulse and set pulse, a third pulse enable signal is provided to a third driver element 315. The superset pulse results in a current flow in the second direction through the winding 208 of latching ferrite circulator 200. The superset pulse is used to overcome problems associated with a memory effect that may be present in the switching element of the latching ferrite circulator 200. The superset pulse must have a large enough amplitude and duration to saturate the latching ferrite circulator 200 in the second direction. In exemplary embodiments, the amplitude and duration of the superset pulse is determined based on the amplitude and duration of the previous set pulse that was applied. In other embodiments, the superset pulse is an amplitude and duration that will saturate the switching element of the latching ferrite circulator 200 regardless of the previous set pulse. The amplitude of the saturating pulse is determined by the supply voltage $V_{high}$ that is provided to the third driver element 315.

FIG. 3B is a block diagram illustrating another example driver circuit 350 according to an embodiment of the present disclosure. Driver circuit 350 can be implemented in software (e.g., firmware), hardware, or a combination thereof. In the exemplary embodiment of FIG. 3B, the driver circuit 350 is implemented in software as an executable program executed in an FPGA, a customized computer, or a general purpose computer.

In exemplary embodiments, driver circuit 350 includes a processor 351, memory 352, and one or more devices that are communicatively coupled via a local interface 354. The local interface 354 can be, for example but not limited to, one or more buses or other wired or wireless connections, as is known in the art. The local interface 354 may have additional elements, which are omitted for simplicity. Further, the local interface may include address, control, and/or data connections to enable appropriate communications among the components described above.

The processor 351 is a hardware device that uses a clock derived from a clock source 353 for executing software stored in memory 352. The processor 351 can be any custom made or commercially available processor, a central processing unit (CPU), an auxiliary processor among several processors associated with a computer, a semiconductor based microprocessor, or the like.

The memory 352 can include any one or combination of volatile memory elements (e.g., random access memory (RAM, such as DRAM, SRAM, SDRAM, etc.)) and non-volatile memory elements (e.g., ROM, hard drive, tape, CDROM, etc.). Moreover, the memory 352 may incorporate electronic, magnetic, optical, and/or other types of storage media.

The software in memory 352 may include one or more separate programs, each of which comprises an ordered listing of executable instructions for implementing logical functions. In the driver circuit 350 shown in FIG. 3B, the software in the memory 352 includes a latching ferrite circulator driver application software 358, an enable signal module 308, and a memory look-up table 306. The latching ferrite circulator driver application software 358 comprises executable instructions for implementing the functionality of the driver circuit 300 discussed above with respect to FIG. 3A. The memory look-up table 306 and the enable signal module 308 operate similarly to those discussed above with respect to FIG. 3A.

The I/O interface 356 provides a communication interface with input devices, for example but not limited to, a keyboard and a mouse and also with output devices, for example but not limited to, a printer, display, etc. A power division measurement system 362 is communicatively coupled to I/O interface 356. The power division measurement system 362 is used to provide clock count information related to various output power ratios that may be settable upon the switching element of the latching ferrite circulator 200. In one configuration, driver elements 312, 314 for driving latching ferrite circulator 200 (not shown) are also coupled to I/O interface 356.

When driver circuit 350 is in operation, processor 351 is configured to execute software stored within the memory 352, to communicate data to and from the memory 352, and to generally control operations of driver circuit 350 pursuant to the software. The driver circuit 350 applies the same saturating-set pulse sequence as that described above with respect to FIGS. 2A-2B and 3A. Also, the driver circuit 350 can optionally apply a superset pulse to the magnetizing winding 208 of the latching ferrite circulator 200.

FIG. 3C is a block diagram illustrating another example driver circuit 375 according to an embodiment of the present disclosure. The driver circuit 375 comprises a pulse control 380, a gate driver 385, an output stage 390, and feedback components 395. In exemplary embodiments, the pulse control 380 comprises a precision pulse generator. The pulse control 380 receives a control signal from the controller interface 110 and provides voltage pulses to the gate driver 385 and the output stage 390. The output stage 390 applies a saturating current pulse and a set current pulse to the magnetizing winding 208, similar to the saturating current pulse and set current pulse described above. The output stage 390 also provides feedback to the pulse control 380 through feedback components 395. In exemplary embodiments, the gate driver 385 is an amplifier or other suitable gate driver known to one having skill in the art. In exemplary embodiments, the output stage 390 can be any output stage known to one having skill in the art. The feedback components can be any suitable combination of feedback components known to one having skill in the art.

Figure 4A:
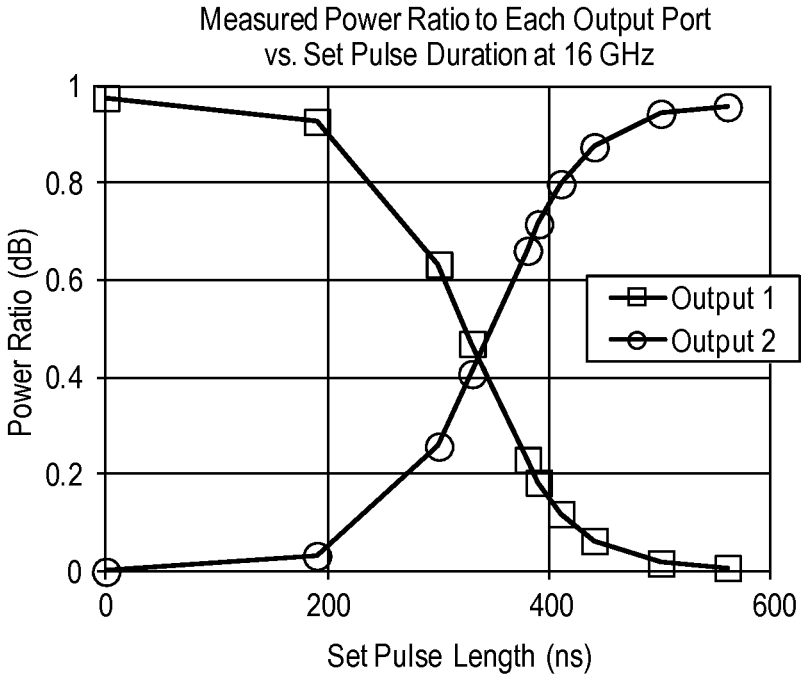
FIG. 4A is a graph illustrating the measured power ratio to each output port for an example variable power divider according to one embodiment of the present disclosure.

FIG. 4A is a graph illustrating the measured power ratio to each output port for an example variable power divider according to one embodiment of the present disclosure. For the particular example shown in FIG. 4A, the output power ratio for each output port for different pulse lengths is shown. For example, when the pulse length is approximately 325 ns, the output power ratio for each output port is approximately 0.5 dB.

Figure 4B:
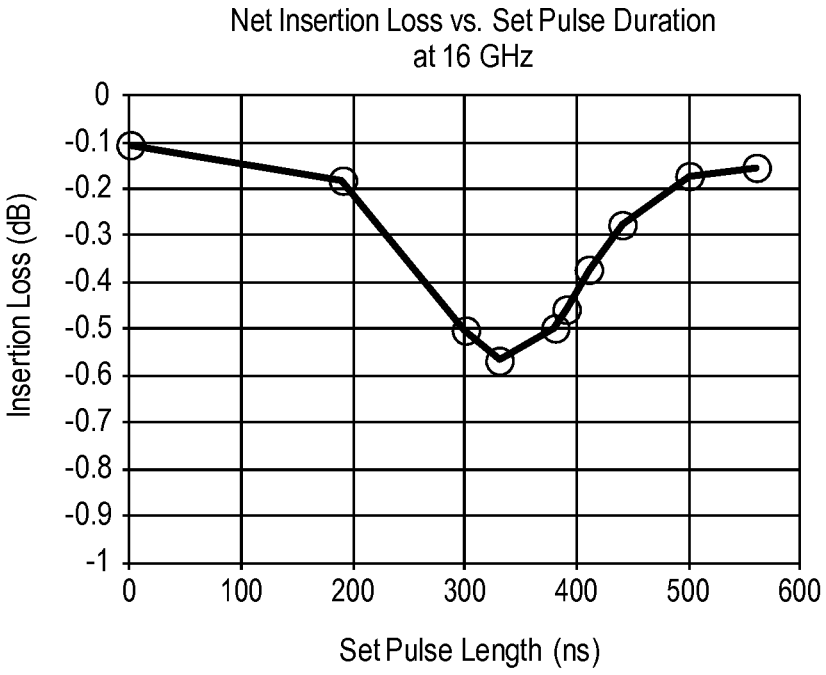
FIG. 4B is a graph illustrating net insertion loss data for an example variable power divider according to one embodiment of the present disclosure.

FIG. 4B is a graph illustrating net insertion loss data for an example variable power divider according to one embodiment of the present disclosure. For the particular example shown in FIG. 4B, the net insertion loss for the variable power divider is 0.1 dB when the latching ferrite circulator 200 is near saturation, i.e. when the set pulse is very small or very large. As the output power ratio gets closer to 0.5 for each output port, which occurs approximately at pulse length of 325 ns, the net insertion loss increases to 0.55 dB. This latching ferrite circulator was originally designed to only operate at saturation or power ratios of 0 or 1, so improved net insertion loss flatness over power ratio is likely with additional impedance matching optimization for the 0.5 power ratio state. Even with this limitation, the performance of the variable power divider shown in FIGS. 4A-4B is acceptable for most variable power division applications.

Figure 5:
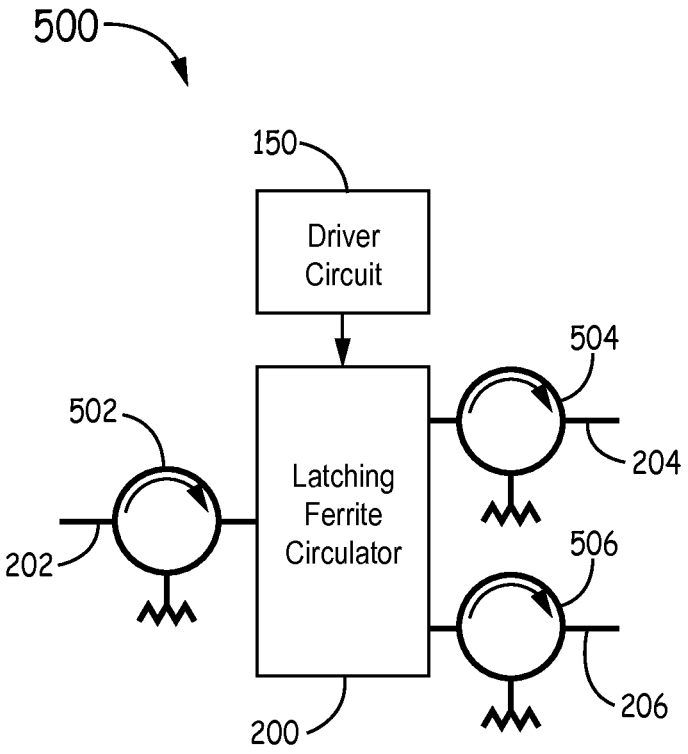
FIG. 5 is a block diagram illustrating an example variable power divider according to an embodiment of the present disclosure.

FIG. 5 is a block diagram illustrating an example variable power divider 500 according to one embodiment of the present disclosure. Specifically, the variable power divider 500 is a modification of variable power divider 100, discussed above, that incorporates two-port junction isolators 502, 504, 506 at each of the input 202 and output ports 204, 206 of the variable power divider 500. By including the two-port junction isolators 502, 504, 506, a more stable return loss for all output power ratios can be achieved.

Figure 6:
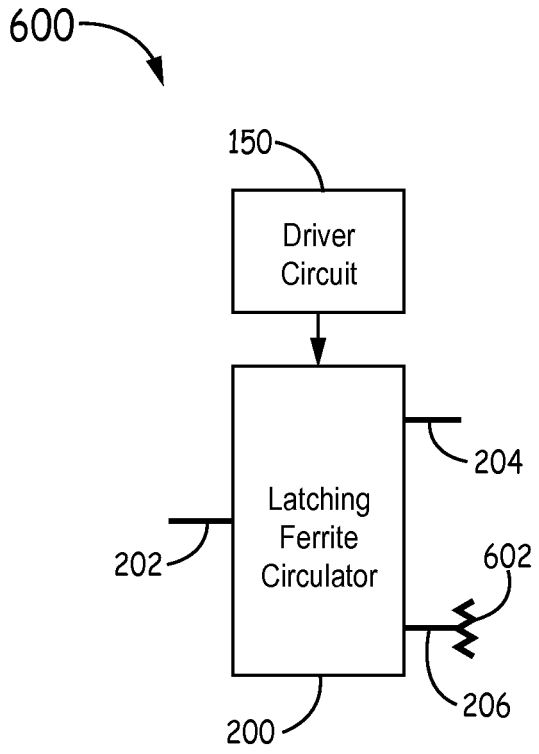
FIG. 6 is a block diagram illustrating an example variable attenuator according to an embodiment of the present disclosure.

FIG. 6 is a block diagram illustrating an example variable attenuator 600 according to one embodiment of the present disclosure. Specifically, variable attenuator 600 is a modification of the variable power divider 100 that incorporates a matched load 602 added to the second output port 206 such that only the first output port 204 is used. In such embodiments, the output power of the first output port 204 can be controlled in a manner similar to the output ports described above.

Figure 7:
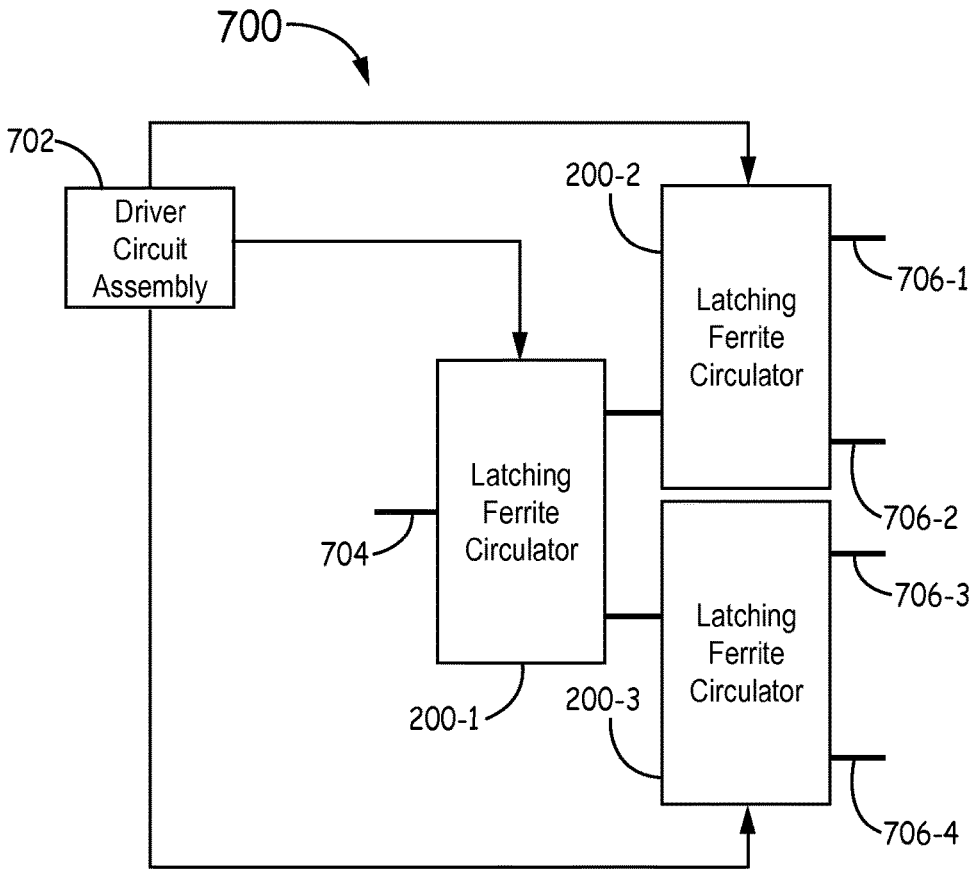
FIG. 7 is a block diagram illustrating an example network of variable power dividers according to an embodiment of the present disclosure.

FIG. 7 illustrates an example embodiment of a network of variable power dividers 700. A plurality of variable power dividers that operate similarly to those discussed above can be combined to produce a network 700 of three-port variable power dividers in a binary tree or other type of configuration. The network includes a driver circuit assembly 702, which comprises individual driver circuits, similar to driver circuits 300, 350, 375 discussed above, for each of the latching ferrite circulators 200-1, 200-2, 200-3. In other embodiments, the network driver assembly 702 includes one driver circuit that controls each of the latching ferrite circulators 200-1, 200-2, 200-3. In the example of FIG. 7, each of the output ports of a first latching ferrite circulator 200-1 can be coupled to the input port of another latching ferrite circulator 200-2, 200-3. Thus, in the embodiment of FIG. 7, there could be up to four output ports 706 in the network 700. Any number of variable power dividers can be incorporated into the network to vary the amount of output ports. Further, by incorporating isolators or attenuators into the network, any variation of input ports to output ports and path combinations can be achieved.

It should be understood to those having skill in the art that the variable power dividers 100, 500, 600, 700 described above can also be reconfigured to operate as power combiners. In particular, the two output ports of a variable power divider 100 would operate as input ports and the input port of a variable power divider 100 would operate as an output port. In such embodiments, the saturating-set pulse sequence can be applied to provide variable weighting on the two input signals. In such embodiments, the power division ratio discussed above would be referred to as a power combination ratio and would determine the particular weighting of the power combined at the output port from the first input port and the second input port.

Figure 8:
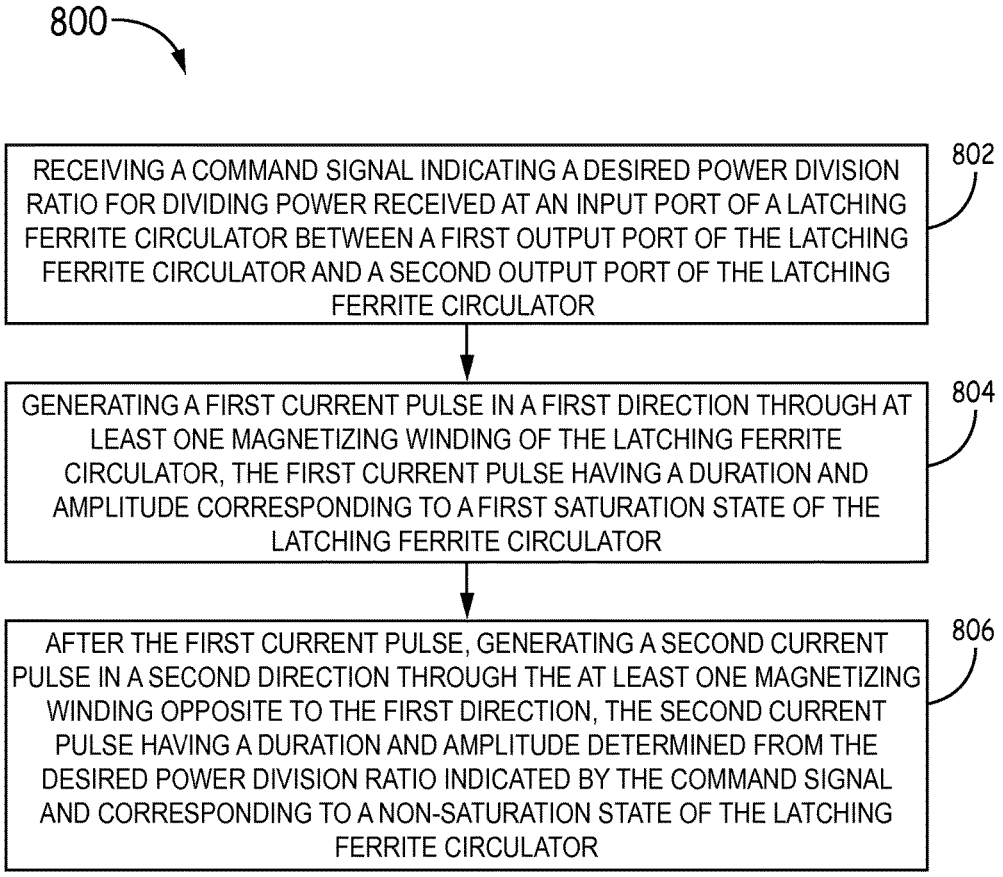
FIG. 8 is a flow chart illustrating an exemplary method of variable power division according to one embodiment of the present disclosure.

FIG. 8 is a flow chart depicting one embodiment of an exemplary method 800 of variable power division according to the present disclosure. Method 800 can be implemented in the variable power dividers 100, 500, 600 described above.

The method 800 begins at 802 with receiving a command signal indicating a desired power division ratio for dividing power received at an input port of a latching ferrite circulator between a first output port of the latching ferrite circulator and a second output port of the latching ferrite circulator.

The method 800 proceeds to 804 with generating a first current pulse in a first direction through at least one magnetizing winding of the latching ferrite circulator, the first current pulse having a duration and amplitude corresponding to a first saturation state of the latching ferrite circulator. In exemplary embodiments, the first current pulse is the saturating pulse discussed above. In exemplary embodiments, the application of the saturating pulse to the switching element of the latching ferrite circulator is based on the most recent magnetization state of the switching element.

The method proceeds to 806 with generating a second current pulse in a second direction through the at least one magnetizing winding opposite to the first direction, the second current pulse having a duration and amplitude determined from the desired power division ratio indicated by the command signal and corresponding to a non-saturation state of the latching ferrite circulator. In exemplary embodiments, the second current pulse is the set pulse discussed above. In exemplary embodiments, the set pulse is generated by a driver circuit that includes a memory look-up table that stores a list of desired output power ratios and corresponding pulse width information (for example, driver circuit 300).

Figure 8A:
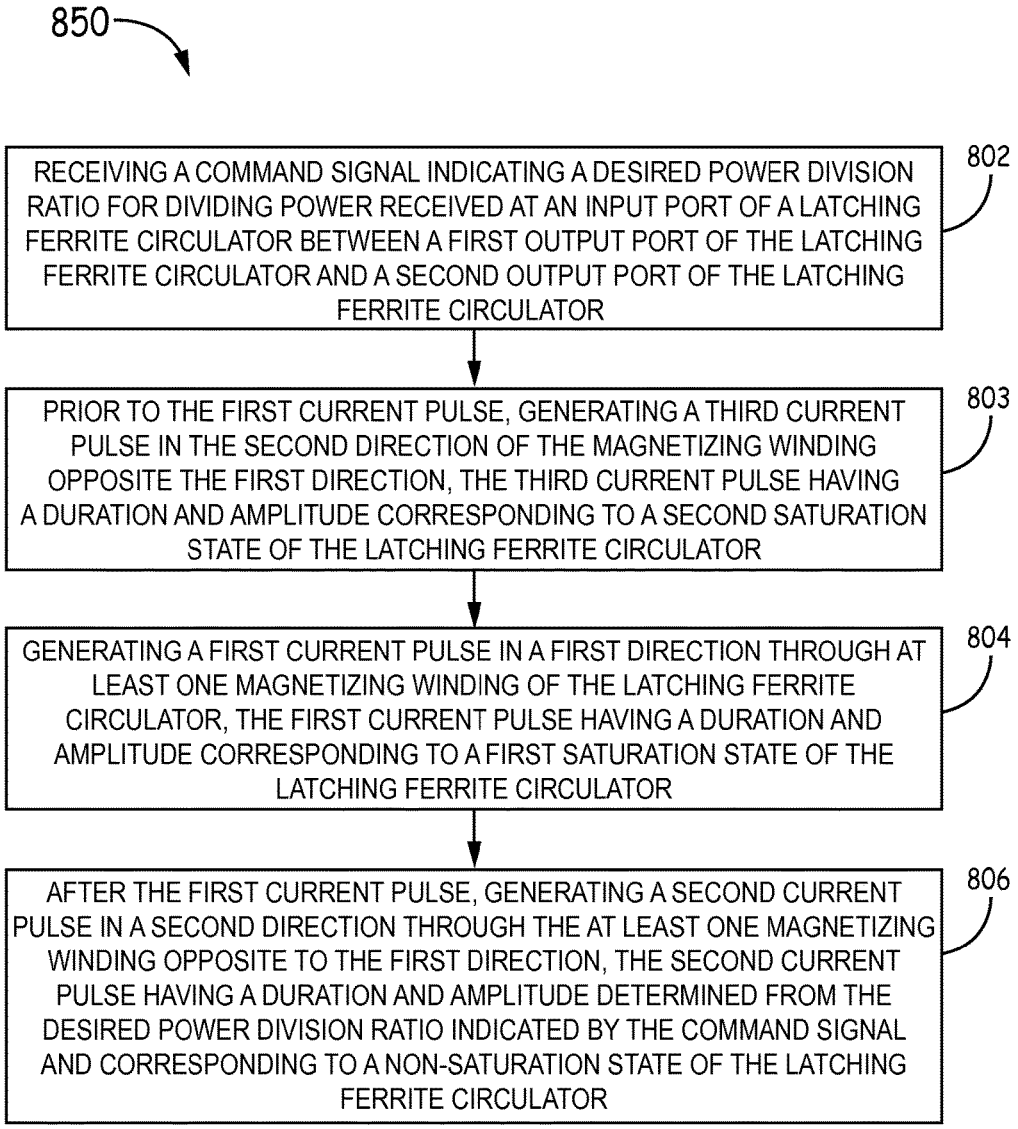
FIG. 8A is a flow chart illustrating an exemplary method of variable power division according to one embodiment of the present disclosure.

FIG. 8A is a flow chart depicting an alternative embodiment of an exemplary method 850 of variable power division according to the present disclosure. Method 850 can be implemented in the variable power dividers 100, 500, 600 described above.

The method 850 begins at 802 with receiving a command signal indicating a desired power division ratio for dividing power received at an input port of a latching ferrite circulator between a first output port of the latching ferrite circulator and a second output port of the latching ferrite circulator.

Method 850 proceeds to 803 with, prior to the first current pulse, generating a third current pulse in the second direction of the magnetizing winding opposite the first direction, the third current pulse having a duration and amplitude corresponding to a second saturation state of the latching ferrite circulator. In exemplary embodiments, the third current pulse is the superset pulse described above. In exemplary embodiments, the application of the superset pulse to the switching element of the latching ferrite circulator is based on the most recent magnetization state of the switching element. Method 850 then proceeds to steps 804 and 806 as described above with respect to method 800.

The variable power dividers and methods of variable power division described above provide a continuous spectrum of output power ratios between the two output ports of a three-port variable power divider. Thus, the systems and methods described above are not limited to three output power ratios as are other power dividers that utilize latching ferrite circulators. This increased flexibility allows for more precise antenna and beam steering compared to other power dividers that utilize latching ferrite circulators, which is particularly useful for satellite applications. Further, the variable power dividers of the present disclosure offer a significant reduction in size compared to present variable power dividers that provide a continuous spectrum of variable power division. Specifically, the variable power dividers of the present disclosure are five to ten times smaller than present variable power dividers. The variable power dividers of the present disclosure have a net insertion loss over the range of set pulse duration that is acceptable for most applications, so similar operational quality can be achieved while significantly reducing size.

In various embodiments, system elements, method steps, or examples described throughout this disclosure (such as the control interface 110 and driver circuits 300, 350, 375 or sub-parts thereof, for example) may be implemented on one or more computer systems, field programmable gate array (FPGA), or similar devices comprising a processor and memory hardware executing code to realize those elements, processes, or examples, said code stored on a non-transient data storage device. Therefore other embodiments of the present disclosure may include such a processor and memory hardware as well as elements comprising program instructions resident on computer readable media which when implemented by such computer systems, enable them to implement the embodiments described herein. As used herein, the term "computer readable media" refers to tangible memory storage devices having non-transient physical forms. Such non-transient physical forms may include computer memory devices, such as but not limited to punch cards, magnetic disk or tape, any optical data storage system, flash read only memory (ROM), non-volatile ROM, programmable ROM (PROM), erasable-programmable ROM (E-PROM), random access memory (RAM), or any other form of permanent, semi-permanent, or temporary memory storage system or device having a physical, tangible form. Program instructions include, but are not limited to computer-executable instructions executed by computer system processors and hardware description languages such as Very High Speed Integrated Circuit (VHSIC) Hardware Description Language (VHDL).

Example Embodiments

Example 1 includes a variable power divider, comprising: a latching ferrite circulator including an input port, a first output port, a second output port, and at least one magnetizing winding, wherein the input port, first output port, and the second output port meet in a common junction; a controller interface having an input that receives a command signal indicating a desired power division ratio for dividing power received at the input port between the first output port and the second output port; and a driver circuit configured to receive a control signal from the controller interface; wherein the driver circuit generates a first current pulse in a first direction through the at least one magnetizing winding, the first current pulse having a duration and amplitude corresponding to a first saturation state of the latching ferrite circulator; wherein after the first current pulse, the driver circuit generates a second current pulse in a second direction through the at least one magnetizing winding opposite to the first direction, the second current pulse having a duration and amplitude determined from the desired power division ratio indicated by the command signal and corresponding to a non-saturation state of the latching ferrite circulator.

Example 2 includes the variable power divider of Example 1, the driver circuit comprising: one or more driver elements; and a digital pulse generator including: a memory coupled to the controller interface; an enable signal module coupled to the one or more driver elements; wherein the enable signal module controls the one or more driver elements to produce the first current pulse and the second current pulse based on data from the memory corresponding to the command signal.

Example 3 includes the variable power divider of Example 2, the one or more driver elements comprising: a first driver element coupled to the at least one magnetizing winding, wherein the first driver element generates the first current pulse; and a second driver element coupled to the at least one magnetizing winding, wherein the second driver element generates the second current pulse.

Example 4 includes the variable power divider of any of Examples 2-3, wherein the controller interface outputs at least one address for the memory based on the command signal and the enable signal module controls the one or more driver elements based on the data from at least one address of the memory, wherein the memory includes a look-up table that includes a plurality of power division ratios and pulse duration information that corresponds to the plurality of power division ratios, wherein the digital pulse generator sets a pulse duration of the second current pulse based on the pulse duration information corresponding to the address.

Example 5 includes the variable power divider of Example 2-4, wherein the driver circuit further comprises a clock coupled to the enable signal module, wherein the pulse duration information corresponds to a particular number of clock counts provided by the clock.

Example 6 includes the variable power divider of any of Examples 2-5, wherein digital pulse generator sets the duration and amplitude of the first current pulse based on a previous magnetization state of the latching ferrite circulator.

Example 7 includes the variable power divider of any of Examples 1-6, wherein the driver circuit further comprises a temperature sensor coupled to the controller interface, wherein the controller interface is configured to compensate the command signal based on an input from the temperature sensor.

Example 8 includes the variable power divider of Example 1, the driver circuit comprising: a pulse control coupled to the controller interface; a gate driver; an output stage; and one or more feedback components coupled to the output stage and the pulse control.

Example 9 includes the variable power divider of any of Examples 1-8, wherein prior to the first current pulse and in response to the command signal, the driver circuit generates a third current pulse in the second direction corresponding to a second saturation state of the latching ferrite circulator that is opposite the first saturation state.

Example 10 includes the variable power divider of any of Examples 1-9, further comprising two-port junction isolators coupled to each of the input port, the first output port, and the second output port.

Example 11 includes the variable power divider of any of Examples 1-10, further comprising a matched load coupled to at least one of the first output port and the second output port.

Example 12 includes the variable power divider of any of Examples 1-11, wherein the at least one magnetizing winding comprises a first magnetizing winding and a second magnetizing winding, wherein the first current pulse is applied to the first magnetizing winding and the second current pulse is applied to the second magnetizing winding.

Example 13 includes the variable power divider of any of Examples 1-12, wherein at least one of the first output port and the second output port is connected to an input port of a second variable power divider.

Example 14 includes the variable power divider of any of Example 13, wherein the driver circuit controls the power division ratio of the second power divider based on the command signal.

Example 15 includes variable power combiner, comprising: a latching ferrite circulator including a first input port, a second input port, an output port, and at least one magnetizing winding, wherein the first input port, second input port, and the output port meet in a common junction; a controller interface having an input that receives a command signal indicating a desired power division ratio for weighting power received at the output port from the first input port and the second input port; and a driver circuit configured to receive a control signal from the controller interface; wherein the driver circuit generates a first current pulse in a first direction through the at least one magnetizing winding, the first current pulse having a duration and amplitude corresponding to a first saturation state of the latching ferrite circulator; wherein after the first current pulse, the driver circuit generates a second current pulse in a second direction through the at least one magnetizing winding opposite to the first direction, the second current pulse having a duration and amplitude determined from the desired power division ratio indicated by the command signal and corresponding to a non-saturation state of the latching ferrite circulator.

Example 16 includes a method of variable power division, comprising: receiving a command signal indicating a desired power division ratio for dividing power received at an input port of a latching ferrite circulator between a first output port of the latching ferrite circulator and a second output port of the latching ferrite circulator; generating a first current pulse in a first direction through at least one magnetizing winding of the latching ferrite circulator, the first current pulse having a duration and amplitude corresponding to a first saturation state of the latching ferrite circulator; after the first current pulse, generating a second current pulse in a second direction through the at least one magnetizing winding opposite to the first direction, the second current pulse having a duration and amplitude determined from the desired power division ratio indicated by the command signal and corresponding to a non-saturation state of the latching ferrite circulator.

Example 17 includes the method of Example 16, further comprising: outputting at least one address of a memory based on the command signal, wherein the memory includes a look-up table comprising a plurality of power division ratios and pulse duration information corresponding to the plurality of power division ratios, wherein the at least one address corresponds to the desired power division ratio indicated by the command signal.

Example 18 includes the method of Example 17, further comprising: compensating the pulse duration information based on input from a temperature sensor.

Example 19 includes the method of any of Examples 16-18, further comprising: prior to the first current pulse, generating a third current pulse in the second direction of the magnetizing winding opposite the first direction, the third current pulse having a duration and amplitude corresponding to a second saturation state of the latching ferrite circulator.

Example 20 includes the method of Example 19, further comprising setting the duration and amplitude of the third current pulse based on a prior magnetization state of the latching ferrite circulator.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. A variable power divider, comprising:

a latching ferrite junction circulator including an input port, a first output port, a second output port, and at least one magnetizing winding, wherein the input port, first output port, and the second output port meet in a common junction;

a controller interface having an input that receives a command signal indicating a desired power division ratio for dividing power received at the input port between the first output port and the second output port;

a driver circuit configured to receive a control signal from the controller interface;

wherein the driver circuit generates a first current pulse in a first direction through the at least one magnetizing winding, the first current pulse having a duration and amplitude corresponding to a first saturation state of the latching ferrite junction circulator; and wherein after the first current pulse, the driver circuit generates a second current pulse in a second direction through the at least one magnetizing winding opposite to the first direction, the second current pulse having a duration and amplitude determined from the desired power division ratio indicated by the command signal and corresponding to a non-saturation state of the latching ferrite junction circulator.

2. The variable power divider of claim 1, the driver circuit comprising:

one or more driver elements;

a digital pulse generator including:

a memory coupled to the controller interface; and an enable signal module coupled to the one or more driver elements; and wherein the enable signal module controls the one or more driver elements to produce the first current pulse and the second current pulse based on data from the memory corresponding to the command signal.

3. The variable power divider of claim 2, the one or more driver elements comprising:

a first driver element coupled to the at least one magnetizing winding, wherein the first driver element generates the first current pulse; and a second driver element coupled to the at least one magnetizing winding, wherein the second driver element generates the second current pulse.

4. The variable power divider of claim 2, wherein digital pulse generator sets the duration and amplitude of the first current pulse based on a previous magnetization state of the latching ferrite junction circulator.

5. The variable power divider of claim 2, wherein the controller interface outputs at least one address for the memory based on the command signal and the enable signal module controls the one or more driver elements based on the data from at least one address of the memory, wherein the memory includes a look-up table that includes a plurality of power division ratios and pulse duration information that corresponds to the plurality of power division ratios, wherein the digital pulse generator sets a pulse duration of the second current pulse based on the pulse duration information corresponding to the address.

6. The variable power divider of claim 5, wherein the driver circuit further comprises a clock coupled to the enable signal module, wherein the pulse duration information corresponds to a particular number of clock counts provided by the clock.

7. The variable power divider of claim 1, wherein the driver circuit further comprises a temperature sensor coupled to the controller interface, wherein the controller interface is configured to compensate the command signal based on an input from the temperature sensor.

8. The variable power divider of claim 1, the driver circuit comprising:

a pulse control coupled to the controller interface;

a gate driver;

an output stage; and one or more feedback components coupled to the output stage and the pulse control.

9. The variable power divider of claim 1, wherein prior to the first current pulse and in response to the command signal, the driver circuit generates a third current pulse in the second direction corresponding to a second saturation state of the latching ferrite junction circulator that is opposite the first saturation state.

10. The variable power divider of claim 1, further comprising two-port junction isolators coupled to each of the input port, the first output port, and the second output port.

11. The variable power divider of claim 1, further comprising a matched load coupled to at least one of the first output port and the second output port.

12. The variable power divider of claim 1, wherein the at least one magnetizing winding comprises a first magnetizing winding and a second magnetizing winding, wherein the first current pulse is applied to the first magnetizing winding and the second current pulse is applied to the second magnetizing winding.

13. The variable power divider of claim 1, wherein at least one of the first output port and the second output port is connected to an input port of a second variable power divider.

14. The variable power divider of claim 13, wherein the driver circuit controls the power division ratio of the second power divider based on the command signal.

15. A variable power combiner, comprising:

a latching ferrite junction circulator including a first input port, a second input port, an output port, and at least one magnetizing winding, wherein the first input port, second input port, and the output port meet in a common junction;

a controller interface having an input that receives a command signal indicating a desired power combination ratio for weighting power combined at the output port from the first input port and the second input port; and a driver circuit configured to receive a control signal from the controller interface;

wherein the driver circuit generates a first current pulse in a first direction through the at least one magnetizing winding, the first current pulse having a duration and amplitude corresponding to a first saturation state of the latching ferrite junction circulator;

wherein after the first current pulse, the driver circuit generates a second current pulse in a second direction through the at least one magnetizing winding opposite to the first direction, the second current pulse having a duration and amplitude determined from the desired power combination ratio indicated by the command signal and corresponding to a non-saturation state of the latching ferrite junction circulator.

16. A method of variable power division, comprising:

receiving a command signal indicating a desired power division ratio for dividing power received at an input port of a latching ferrite junction circulator between a first output port of the latching ferrite junction circulator and a second output port of the latching ferrite junction circulator;

generating a first current pulse in a first direction through at least one magnetizing winding of the latching ferrite junction circulator, the first current pulse having a duration and amplitude corresponding to a first saturation state of the latching ferrite junction circulator;

after the first current pulse, generating a second current pulse in a second direction through the at least one magnetizing winding opposite to the first direction, the second current pulse having a duration and amplitude determined from the desired power division ratio indicated by the command signal and corresponding to a non-saturation state of the latching ferrite junction circulator.

17. The method of claim 16, further comprising: outputting at least one address of a memory based on the command signal, wherein the memory includes a look-up table comprising a plurality of power division ratios and pulse duration information corresponding to the plurality of power division ratios, wherein the at least one address corresponds to the desired power division ratio indicated by the command signal.

18. The method of claim 17, further comprising: compensating the pulse duration information based on input from a temperature sensor.

19. The method of claim 16, further comprising: prior to the first current pulse, generating a third current pulse in the second direction of the magnetizing winding opposite the first direction, the third current pulse having a duration and amplitude corresponding to a second saturation state of the latching ferrite junction circulator.

20. The method of claim 19, further comprising setting the duration and amplitude of the third current pulse based on a prior magnetization state of the latching ferrite junction circulator.

* * * * *